US007828603B1

(12) United States Patent
Ku et al.

(10) Patent No.: US 7,828,603 B1
(45) Date of Patent: Nov. 9, 2010

(54) ELECTRICAL CONNECTOR WITH CROSSTALK COMPENSATION

(75) Inventors: Ying-Ming Ku, Taoyuan (TW); Yi-Huang Lee, Taoyuan (TW)

(73) Assignee: YFC-Boneagle Electric Co., Ltd., Taoyuan (TW)

( * ) Notice: Subject to any disclaimer, the term of this patent is extended or adjusted under 35 U.S.C. 154(b) by 0 days.

(21) Appl. No.: 12/683,617

(22) Filed: Jan. 7, 2010

(51) Int. Cl.
*H01R 24/00* (2006.01)

(52) U.S. Cl. ..... 439/676; 439/941

(58) Field of Classification Search ..... 439/676, 439/941

See application file for complete search history.

(56) References Cited

U.S. PATENT DOCUMENTS

| | | | | |
|---|---|---|---|---|
| 5,186,647 | A * | 2/1993 | Denkmann et al. | 439/676 |
| 5,299,956 | A | 4/1994 | Brownell et al. | |
| 5,586,914 | A * | 12/1996 | Foster et al. | 439/676 |
| 6,089,923 | A | 7/2000 | Phommachanh | |
| 6,165,023 | A * | 12/2000 | Troutman et al. | 439/676 |
| 6,464,529 | B1 * | 10/2002 | Jensen et al. | 439/405 |
| 7,179,115 | B2 * | 2/2007 | Hashim | 439/941 |
| 7,402,085 | B2 * | 7/2008 | Hammond et al. | 439/676 |
| 7,549,890 | B2 * | 6/2009 | Hashim | 439/941 |
| 2003/0186591 | A1 * | 10/2003 | Jensen et al. | 439/676 |
| 2005/0239338 | A1 * | 10/2005 | Hashim | 439/676 |
| 2005/0250372 | A1 | 11/2005 | Doorhy et al. | |
| 2007/0238367 | A1 | 11/2007 | Hammond, Jr. et al. | |
| 2008/0132123 | A1 * | 6/2008 | Milette et al. | 439/676 |
| 2010/0167589 | A1 * | 7/2010 | Hammond et al. | 439/941 |

FOREIGN PATENT DOCUMENTS

| | | | |
|---|---|---|---|
| EP | 1826879 | A1 | 8/2007 |
| WO | 2005053324 | A2 | 9/2005 |
| WO | 2009102851 | A1 | 8/2009 |

OTHER PUBLICATIONS

European Search Report.

* cited by examiner

*Primary Examiner*—Briggitte R Hammond
(74) *Attorney, Agent, or Firm*—Chun-Ming Shih; HDLS IPR Services

(57) ABSTRACT

An electrical connector with crosstalk compensation includes a substrate (10), a first conducting group (G1), a second conducting group (G2), a first metal conducting wire (C1), and a second metal conducting wire (C2). A first conducting pair (S21) of the second conducting group (G2) is electrically connected to a first conducting pair (S11) of the first conducting group (G1) to form a first signal loop pair (L1). Furthermore, a second conducting pair (S22) of the second conducting group (G2) is electrically connected to a second conducting pair (S12) of the first conducting group (G1) to form a second signal loop pair (L2). The first metal conducting wire (C1) and the second metal conducting wire (C2) are electrically connected to a second conductor (R21) and a fourth conductor (R22) of the second conducting group (G2), respectively. Therefore, the first metal conducting wire (C1) and the second metal conducting wire (C2) are installed in parallel on the substrate (10) to obtain a compensation capacitance to reduce and even cancel a crosstalk noise induced between the first signal loop pair (L1) and the second signal loop pair (L2) when signals are sent through either of the two signal loop pairs (L1, L2).

7 Claims, 8 Drawing Sheets

ELECTRICAL CONNECTOR WITH CROSSTALK COMPENSATION

BACKGROUND OF THE INVENTION

1. Field of the Invention

The present invention relates to an electrical connector, and more particularly to an electrical connector with a crosstalk compensation provided by installing metal conducting wires in parallel or metal plates.

2. Description of Prior Art

With the progress of external frequency of the motherboard and bandwidth capacity of the portable electronic products, the interconnection components, such as PCBs, electrical connectors, and cables are developed toward the trend of high data-rate and high density. However, high-frequency effects caused by the interconnection components can not be ignored. Because of high-speed transmission for the wire communication interface, the wire communication interface can not be replaced by the wireless communication interface. Accordingly, the issue of the high-frequency effect is necessary to be overcome.

The crosstalk noise results from the coupled capacitance between adjacent electrical wires. Hence, the crosstalk noise is produced when signals are sent through adjacent traces on the printed circuit board. Also, the effect of the crosstalk noise can not be overlooked for the entire circuit.

U.S. Pat. No. 5,299,956 disclosed a low crosstalk electrical connector system. Reference is made to FIG. 1 which is a circuit diagram of a prior art electrical connecting apparatus. The electrical connector system mainly includes an electrical connection apparatus, and the electrical connection apparatus includes an electrical connector 10A and a circuit board 20A. The electrical connector 10A includes at least one first conductor T1, a second conductor R1, a third conductor R2, and a fourth conductor T2. More particularly, a first signal pair (not labeled) is composed of the first conductor T1 and the second conductor R1; a second signal pair (not labeled) is composed of the third conductor R2 and the fourth conductor T2. In addition, the first conductor T1 and the second conductor R1 are adjacent to and parallel to one another through at least a major portion of the electrical connector 10A. Also, the third conductor R2 is adjacent to and parallel to the first conductor T1, and the fourth conductor T2 is adjacent to and parallel to the second conductor R1 the electrical connector 10A thereby forming a first group of signal paths (not labeled). Hence, the crosstalk noise is induced between the first signal loop pair and the second signal loop pair when signals are applied to either of the signal loop pairs.

Accordingly, a method for canceling the induced crosstalk noise is disclosed. The third conductor R2 is adjacent to and parallel to the second conductor R1, and the fourth conductor T2 is adjacent to and parallel to the first conductor T1 for at least a portion of the substrate forming a second group of signal paths (not labeled). Hence, the second group of signal paths is formed by adjusting the relative position of the conductors (T1, R1, T2, R2) to counteract the induced crosstalk noise.

However, because the relative position of the conductors is fixed, the electrical connector with crosstalk compensation can not suitably provide a compensation capacitance to cancel the induced crosstalk noise when the crosstalk noise magnitude is significantly varied.

Accordingly, an electrical connector with crosstalk compensation is provided to solve the above-mentioned problems.

SUMMARY OF THE INVENTION

In order to solve the above-mention problems, an electrical connector with crosstalk compensation is disclosed. The electrical connector with crosstalk compensation includes a substrate, a first conducting group, a second conducting group, a first metal conducting wire, and a second metal conducting wire.

The first conducting group is installed on the substrate and has at least four conductors. More particularly, the four conductors include a first conductor, a second conductor, a third conductor, and a fourth conductor, respectively. Also, two conductors form a conducting pair in pairs. Namely, the first conductor and the second conductor form a first conducting pair, and the third conductor and the fourth conductor form a second conducting pair.

The second conducting group is installed on the substrate and has at least four conductors. More particularly, the four conductors include a first conductor, a second conductor, a third conductor, and a fourth conductor, respectively. Also, two conductors form a conducting pair in pairs. Namely, the first conductor and the second conductor form a first conducting pair, and the third conductor and the fourth conductor form a second conducting pair.

In addition, the first conducting pair of the second conducting group is electrically connected to the first conducting pair of the first conducting group to form a first signal loop pair, and the second conducting pair of the second conducting group is electrically connected to the second conducting pair of the first conducting group to form a second signal loop pair.

The first metal conducting wire is electrically connected to the second conductor of the second conducting group. The second metal conducting wire is electrically connected to the fourth conductor of the second conducting group.

Therefore, the first metal conducting wire and the second metal conducting wire are installed in parallel on the substrate to obtain a compensation capacitance to reduce and even cancel a crosstalk noise induced between the first signal loop pair and the second signal loop pair when signals are sent through either of the two signal loop pairs.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION OF THE INVENTION

Figure 1:
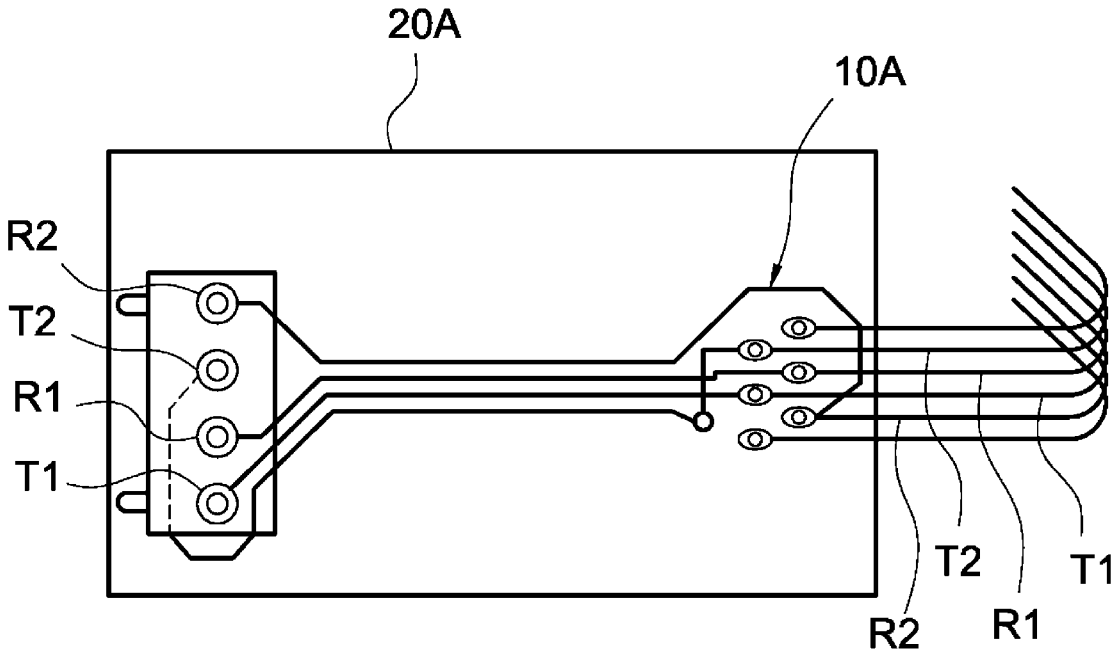
FIG.1 (Prior Art)
FIG. 1 is a circuit diagram of a prior art electrical connecting apparatus.

Reference will now be made to the drawing figures to describe the present invention in detail.

Figure 2A:
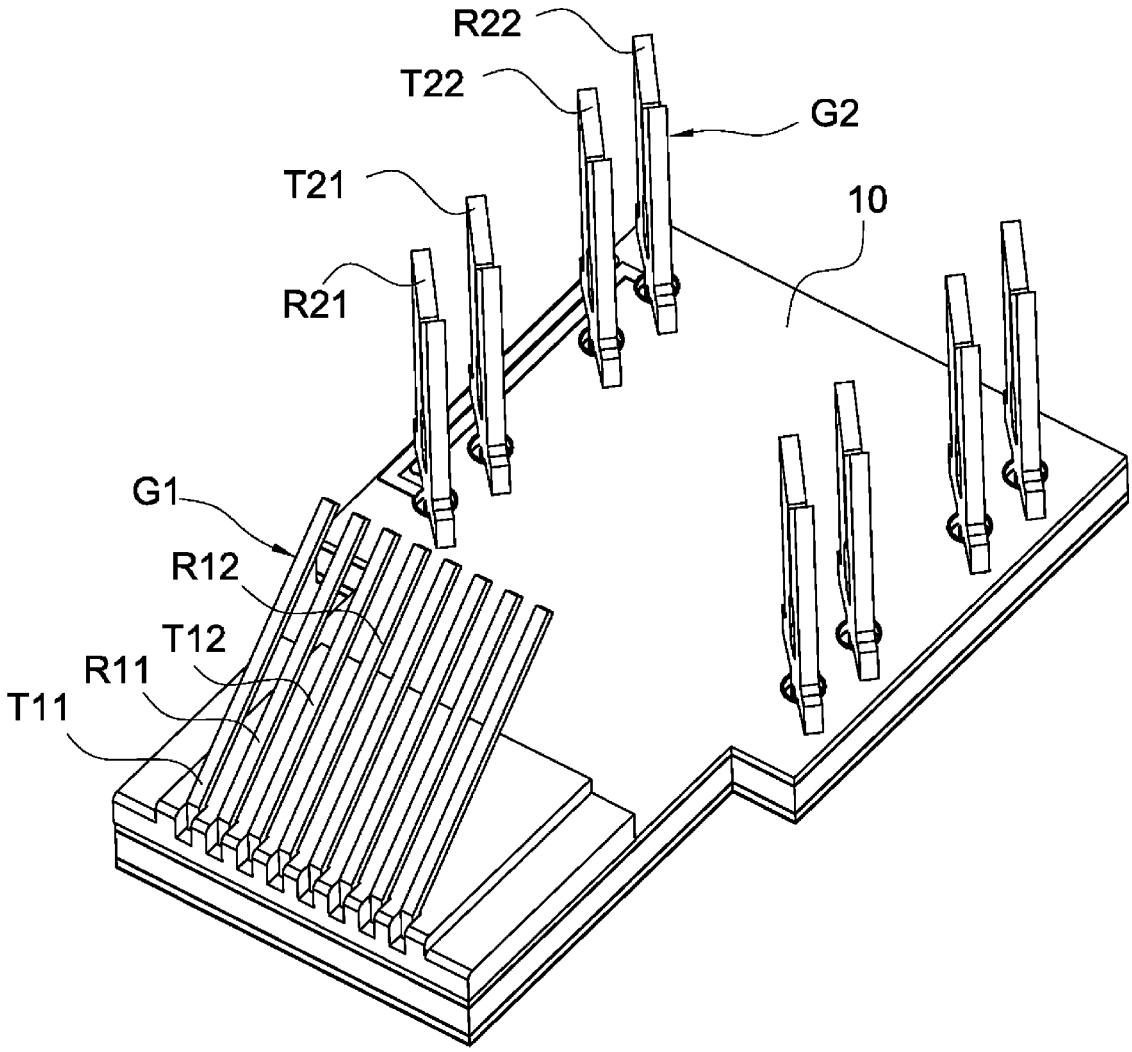
FIG. 2A is a perspective view of a first embodiment of an electrical connector with crosstalk compensation according to the present invention.
Figure 2B:
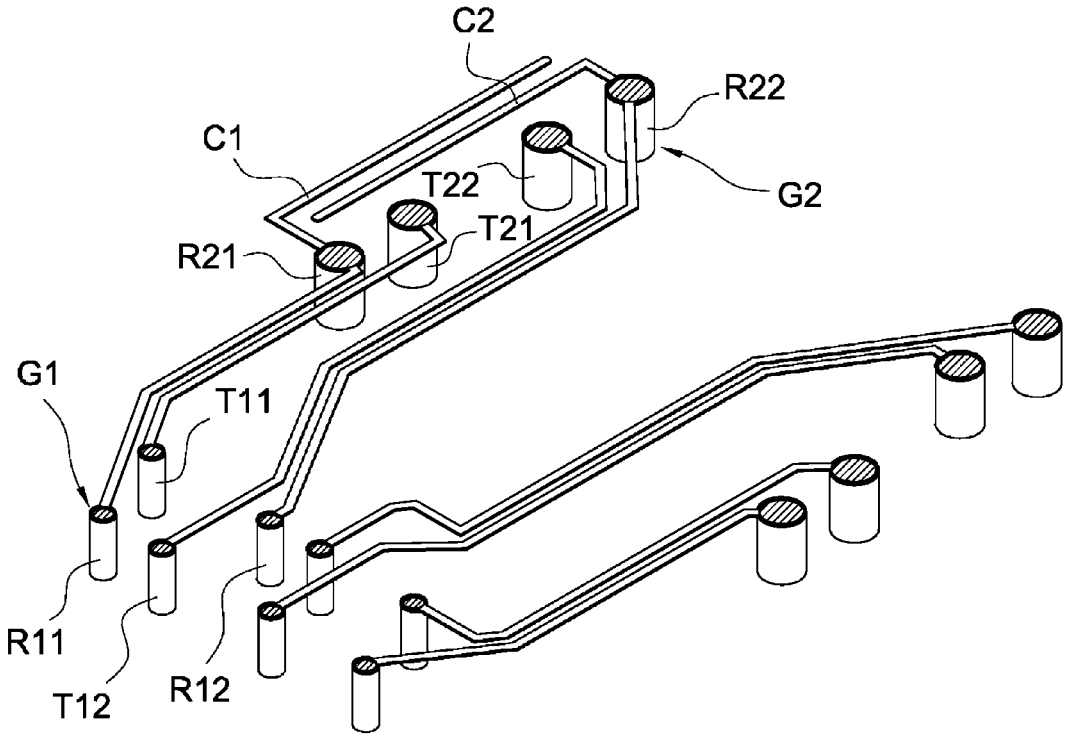
FIG. 2B is a circuit diagram of the first embodiment of the electrical connector.
Figure 2C:
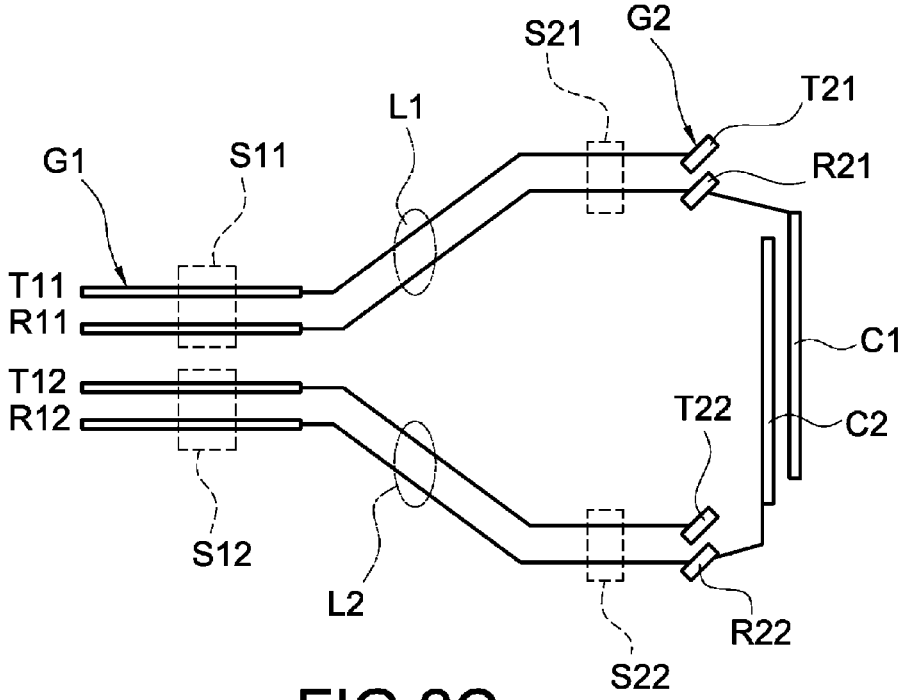
FIG. 2C is a schematic view of the first embodiment of the electrical connector.

Reference is made to FIG. 2A, FIG. 2B, and FIG. 2C which are a perspective view, a circuit diagram, and a schematic view of a first embodiment of the electrical connector, respectively. The electrical connector with crosstalk compensation includes a substrate 10, a first conducting group G1, a second conducting group G2, a first metal conducting wire C1, and a second metal conducting wire C2.

The substrate 10 is a printed circuit board. The first conducting group G1 is installed on the substrate 10 and has at least four conductors. More particularly, the four conductors include a first conductor T11, a second conductor R11, a third conductor T12, and a fourth conductor R12, respectively. Also, two conductors form a conducting pair in pairs. Namely, the first conductor T11 and the second conductor R11 form a first conducting pair S11, and the third conductor T12 and the fourth conductor R12 form a second conducting pair S12.

The second conducting group G2 is installed on the substrate 10 and has at least four conductors. More particularly, the four conductors include a first conductor T21, a second conductor R21, a third conductor T22, and a fourth conductor R22, respectively. Also, two conductors form a conducting pair in pairs. Namely, the first conductor T21 and the second conductor R21 form a first conducting pair S21, and the third conductor T22 and the fourth conductor R22 form a second conducting pair S22. The first conducting pair S21 of the second conducting group G2 is electrically connected to the first conducting pair S11 of the first conducting group G1 to form a first signal loop pair L1. The second conducting pair S22 of the second conducting group G2 is electrically connected to the second conducting pair S12 of the first conducting group G1 to form a second signal loop pair L2.

In addition, the first metal conducting wire C1 is electrically connected to the second conductor R21 of the second conducting group G2. The second metal conducting wire C2 is electrically connected to the fourth conductor R22 of the second conducting group G2. More particularly, the first metal conducting wire C1 and the second metal conducting wire C2 are both of the line structure.

An induced crosstalk noise is produced between the first signal loop pair L1 and the second signal loop pair L2 when signals are sent through either of the first signal loop pair L1 and the second signal loop pair L2. More particularly, magnitude of the crosstalk noise is determined by a coupled capacitance between the first signal loop pair L1 and the second signal loop pair L2. Hence, a capacitance Cr1*r*2, which is used to compensate the induced crosstalk noise, is provided by installing the first metal conducting wire C1 and the second metal conducting wire C2 in parallel on the substrate 10. In the first embodiment, the second conductor R21 and the fourth conductor R22 of the second conducting group G2 are electrically connected to the first metal conducting wire C1 and the second metal conducting wire C2, respectively. Also, the coupled capacitance between the first metal conducting wire C1 and the second metal conducting wire C2 can be calculated as following equation 1:

$$C = \frac{\varepsilon \cdot A}{d} \qquad \text{(equation 1)}$$

wherein, the symbol $\epsilon$ is permittivity parameter, which is equal to the permittivity of vacuum $\epsilon_0$ multiplies the relative permittivity $\epsilon_r$ (namely, $\epsilon=\epsilon_0 \cdot \epsilon_r$). Also, the permittivity of vacuum $\epsilon_0$ equals $\epsilon_0=8.854\times10^{-12}$ (F/m).

In this example, the second conductor R21 is electrically connected to the first metal conducting wire C1, and the fourth conductor R22 is electrically connected to the second metal conducting wire C2. It is assumed that the specification, such as length, width, pitch of the first metal conducting wire C1 and the second metal conducting wire C2 are the same. By definition, the linear relative permittivity of vacuum is equal to 1. Hence, the compensation capacitance Cr1*r*2 could be calculated.

In the actual application, however, because the painting, which is coated on surface of the substrate 10, is slightly distributed between the first metal conducting wire C1 and the second metal conducting wire C2, the actual compensation capacitance required is different from the above-mentioned calculated capacitance.

In the actual application, such as length, width, pitch, width of the first metal conducting wire C1 and the second metal conducting wire C2 are designed according to the equation 1 and actual use thereof when the coupled capacitance is measured. Hence, the crosstalk noise induced between the first signal loop pair L1 and the second signal loop pair L2 can be reduced and even canceled when signals are sent through either of the two signal loop pairs L1, L2.

Accordingly, in this embodiment, the equivalent capacitance Cr1*r*2 can be obtained by electrically connecting the second conductor R21 to the second metal conducting wire C2 and electrically connecting the fourth conductor R22 to the first metal conducting wire C1. The difference between this embodiment and the above-mentioned embodiment is only the connection relationship. Hence, the detail description is omitted here for conciseness.

Figure 3A:
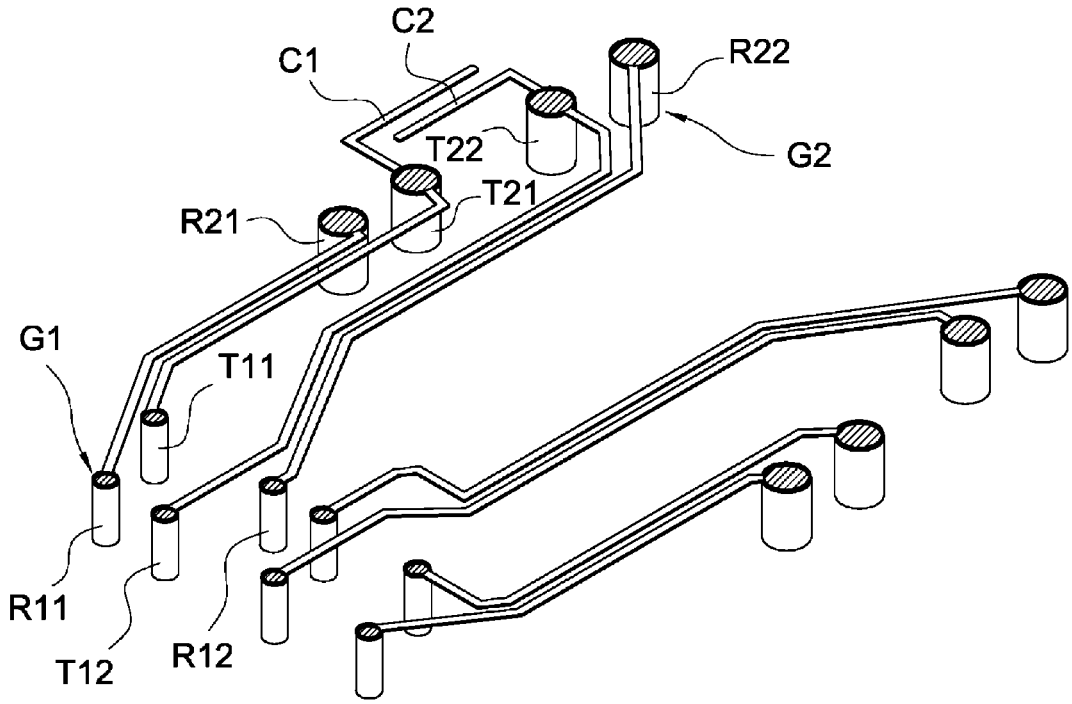
FIG. 3A is a circuit diagram of a second embodiment of the electrical connector.
Figure 3B:
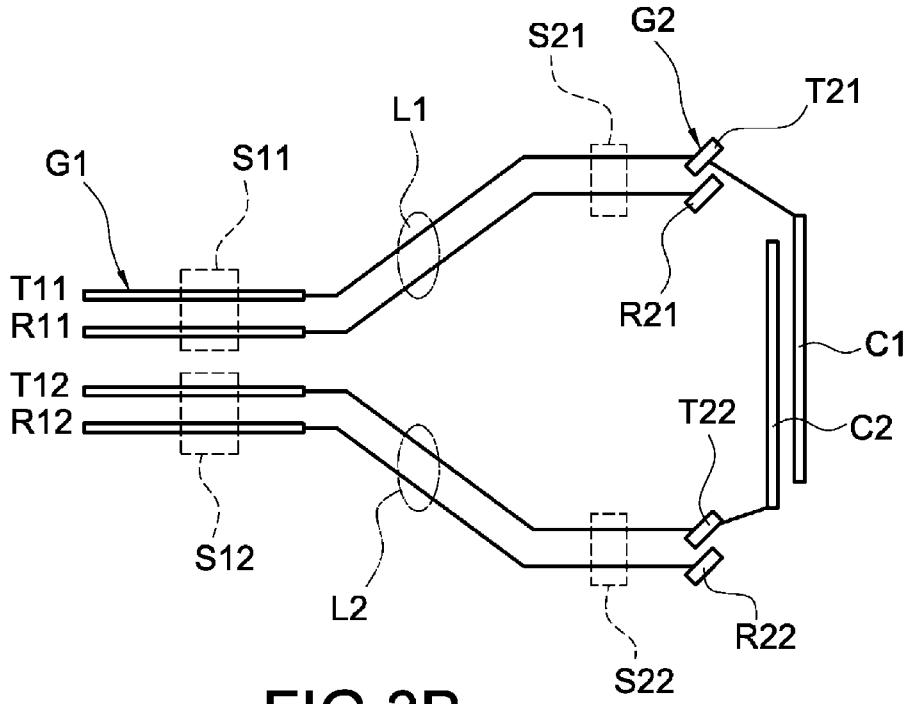
FIG. 3B is a schematic view of the second embodiment of the electrical connector.

Reference is made to FIG. 3A and FIG. 3B which is a circuit diagram and a schematic view of a second embodiment of the electrical connector, respectively. A compensation capacitance between the first signal loop pair L1 and the second signal loop pair L2 can be also obtained in this embodiment. Hence, the capacitance Ct1*t*2, which is also used to compensate the induced crosstalk noise, is provided by installing the first metal conducting wire C1 and the second metal conducting wire C2 in parallel on the substrate 10. In the second embodiment, the first conductor T21 and the third conductor T22 of the second conducting group G2 are electrically connected to the first metal conducting wire C1 and the second metal conducting wire C2, respectively. Similarly, it is assumed that the specification, such as length, width, pitch of the first metal conducting wire C1 and the second metal conducting wire C2 are the same. By definition, the linear relative permittivity of vacuum is equal to 1. Hence, the compensation capacitance Ct1*t*2 could be calculated.

In the actual application, such as length, width, pitch, width of the first metal conducting wire C1 and the second metal conducting wire C2 are designed according to the equation 1 and actual use thereof when the coupled capacitance is measured. Hence, the crosstalk noise induced between the first signal loop pair L1 and the second signal loop pair L2 can be reduced and even canceled when signals are sent through either of the two signal loop pairs L1, L2.

Accordingly, in this embodiment, the equivalent capacitance Ct1*t*2 can be provided by electrically connecting the first conductor T21 to the second metal conducting wire C2 and electrically connecting the third conductor T22 to the first metal conducting wire C1. The difference between this embodiment and the above-mentioned embodiment is only the connection relationship. Hence, the detail description is omitted here for conciseness.

Figure 4A:
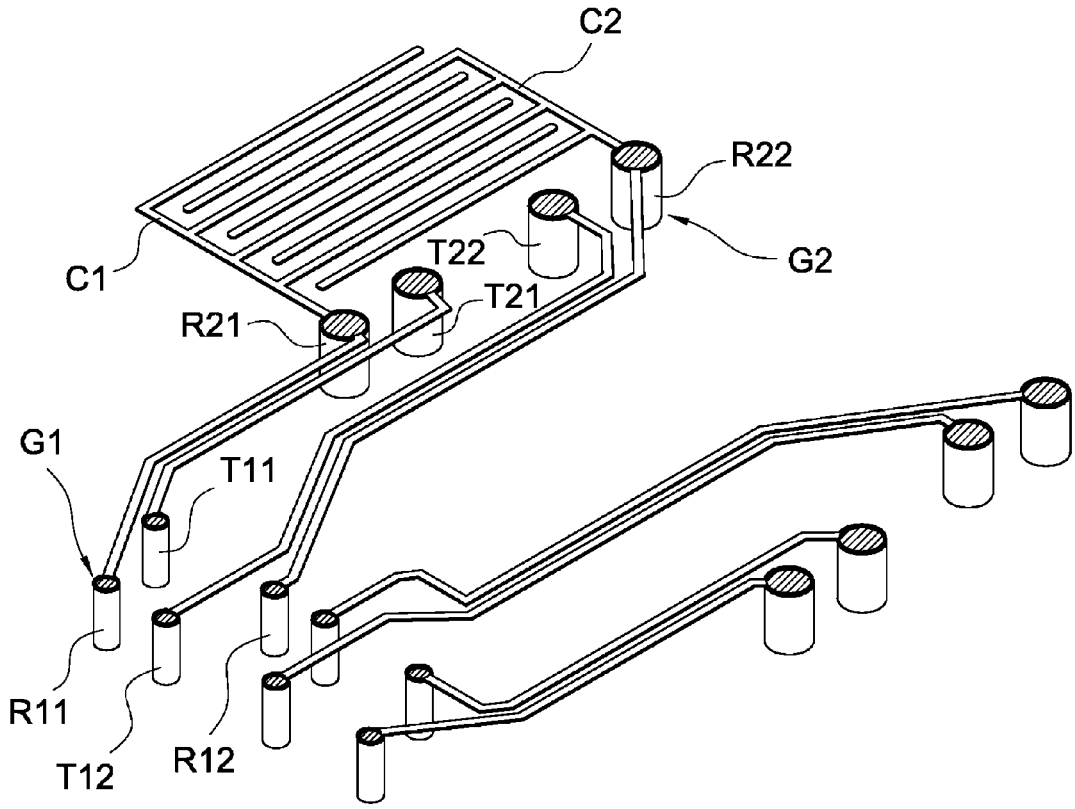
FIG. 4A is a circuit diagram of a third embodiment of the electrical connector.
Figure 4B:
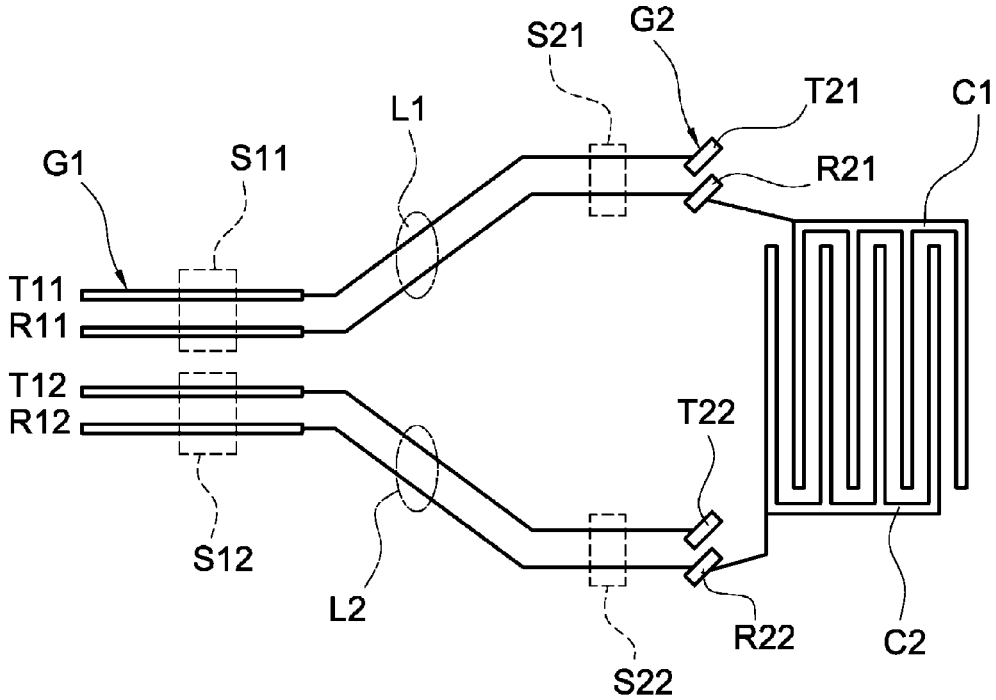
FIG. 4B is a schematic view of the third embodiment of the electrical connector.

Reference is made to FIG. 4A and FIG. 4B which are a circuit diagram and a schematic view of a third embodiment of the electrical connector. This embodiment is same as the first embodiment in that the capacitance Cr1*r*2, which is used to compensate the induced crosstalk noise, is provided by installing the first metal conducting wire C1 and the second metal conducting wire C2 in parallel on the substrate 10. The second conductor R21 and the fourth conductor R22 of the second conducting group G2 are electrically connected to the first metal conducting wire C1 and the second metal conducting wire C2, respectively. However, the difference between the two embodiments is that the first metal conducting wire C1 and the second metal conducting wire C2 are both the comb-shaped structure in this embodiment. According to the equation 1, the compensation capacitance is proportional to the area between the metal conducting wires. Hence, the first metal conducting wire C1 and the second metal conducting wire C2 are interleavingly installed (namely staggered to each other) on the substrate 10 to increase the area between thereof.

Figure 5A:
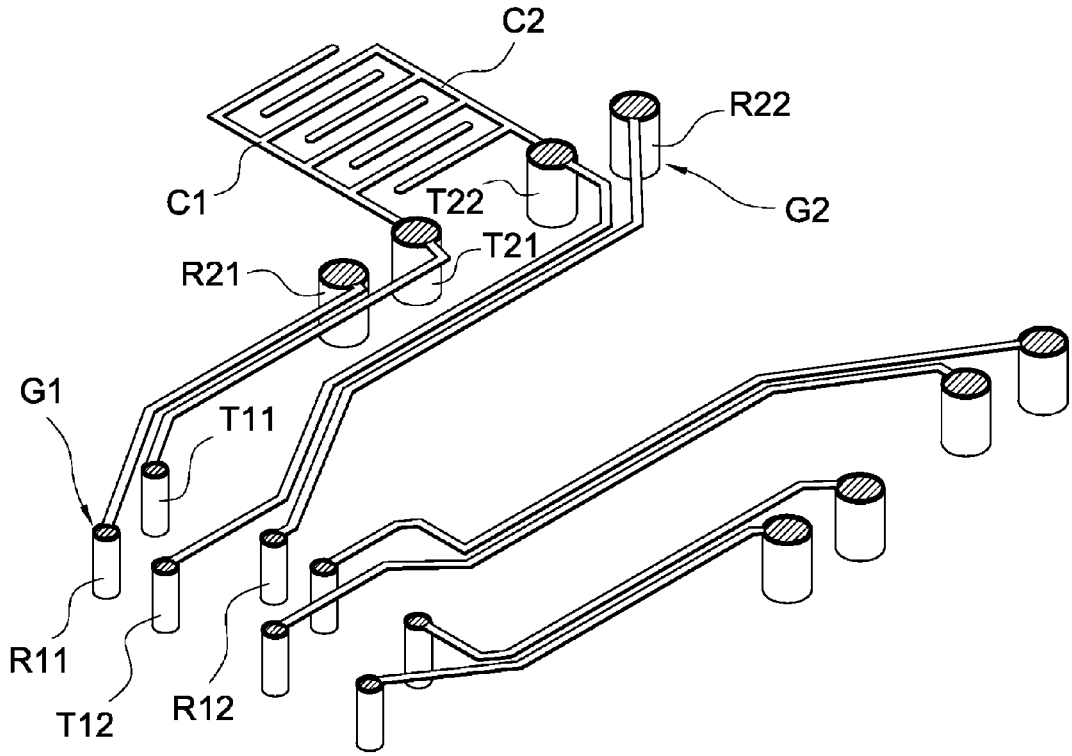
FIG. 5A is a circuit diagram of a fourth embodiment of the electrical connector.
Figure 5B:
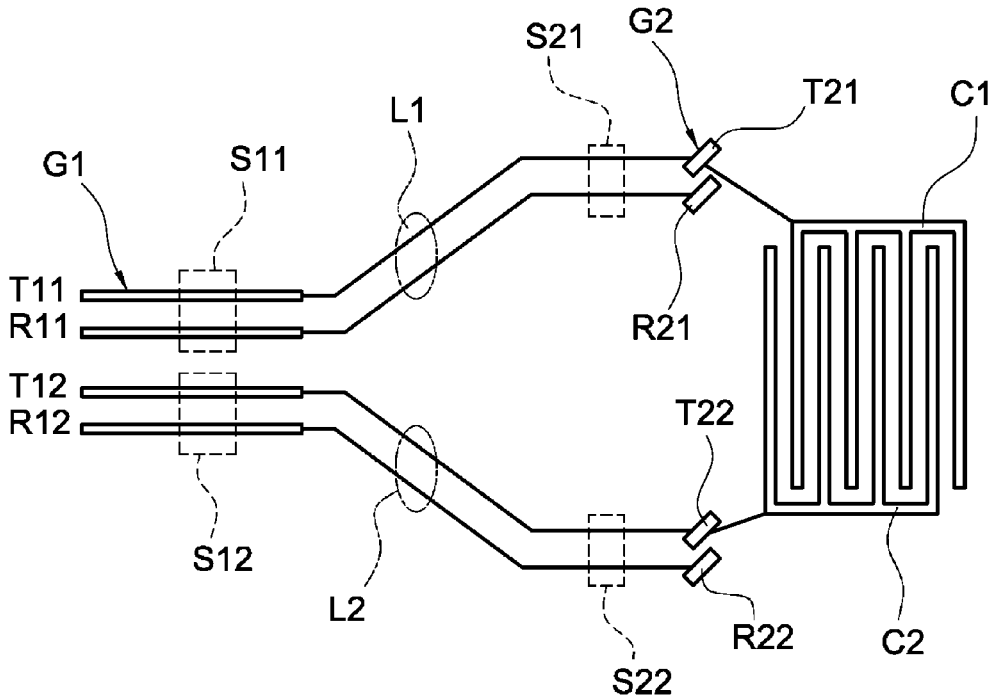
FIG. 5B is a schematic view of the fourth embodiment of the electrical connector.

Reference is made to FIG. 5A and FIG. 5B which is a circuit diagram and a schematic view of a fourth embodiment of the electrical connector. This embodiment is same as the second embodiment in that the capacitance Ct1*t*2, which is used to compensate the induced crosstalk noise, is provided by installing the first metal conducting wire C1 and the second metal conducting wire C2 in parallel on the substrate 10. The first conductor T21 and the third conductor T22 of the second conducting group G2 are electrically connected to the first metal conducting wire C1 and the second metal conducting wire C2, respectively. However, the difference between the two embodiments is that the first metal conducting wire C1 and the second metal conducting wire C2 are both the comb-shaped structure in this embodiment. According to the equation 1, the compensation capacitance is proportional to the area between the metal conducting wires. Hence, the first metal conducting wire C1 and the second metal conducting wire C2 are interleavingly installed (namely staggered to each other) on the substrate 10 to increase the area between thereof.

Figure 6A:
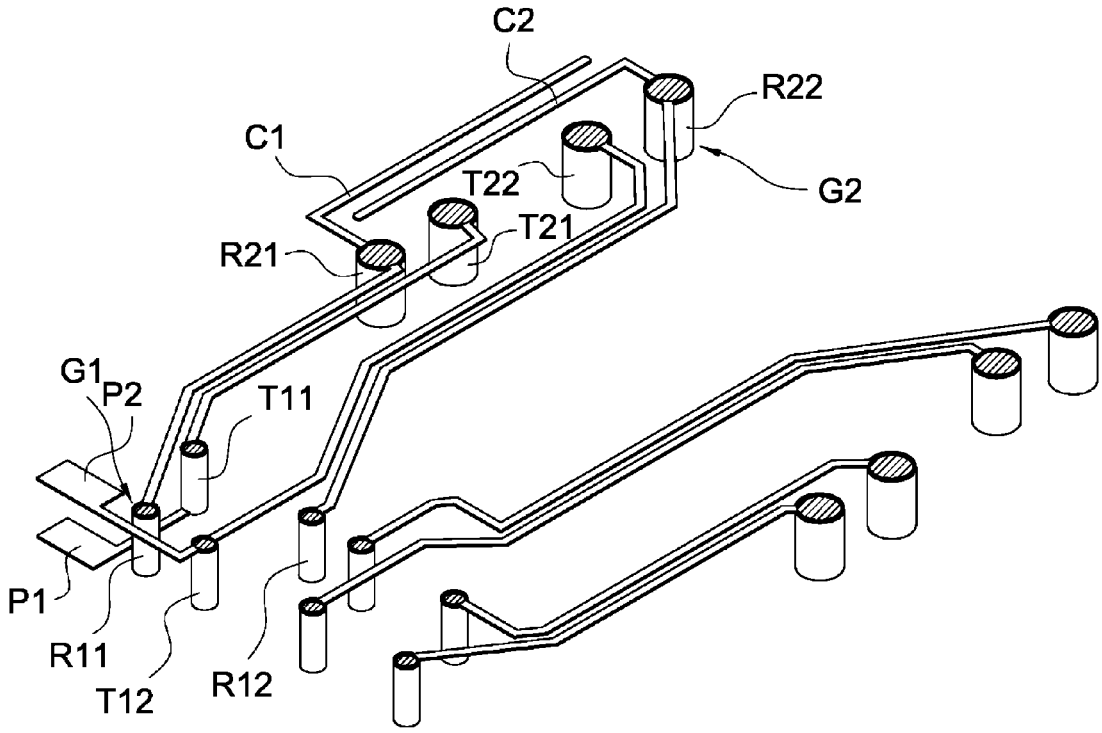
FIG. 6A is a circuit diagram of a fifth embodiment of the electrical connector.
Figure 6B:
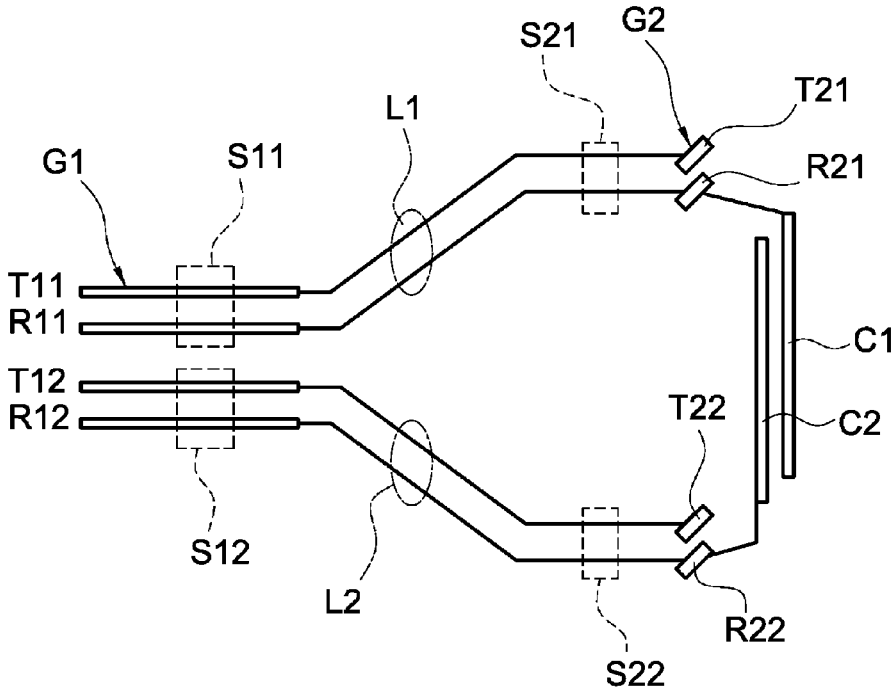
FIG. 6B is a schematic view of the fifth embodiment of the electrical connector.

Reference is made to FIG. 6A and FIG. 6B which are a circuit diagram and a schematic view of a fifth embodiment of the electrical connector. The difference between the first embodiment and this embodiment is that, in this embodiment, the electrical connector further includes a first metal plate P1 and a second metal plate P2. The first metal plate P1 is electrically connected to first conductor T11 of the first conducting group G1, and the second metal plate P2 is electrically connected to third conductor T12 of the first conducting group G1.

First, only the first metal plate P1 and the second metal plate P2 are considered in this embodiment, namely, the first metal conducting wire C1 and the second metal conducting wire C2 are not considered. Hence, the first metal plate P1 and the second metal plate P2 are designed according to the equation 1 and actual use thereof.

In this embodiment, it is assumed that the specification, such as area, pitch of the first metal plate P1 and the second metal plate P2 are the same. Also, the relative permittivity of the printed circuit board is determined. Hence the compensation capacitance Ct1*t*2 can be calculated according to the specification.

In the actual application, such as length, width, pitch, width of the first metal plate P1 and the second metal plate P2 are designed according to the equation 1 and actual use thereof when the coupled capacitance is measured. Hence, the crosstalk noise induced between the first signal loop pair L1 and the second signal loop pair L2 can be reduced and even canceled when signals are sent through either of the two signal loop pairs L1, L2.

Furthermore, the first metal conducting wire C1 and the second metal conducting wire C2 are considered. Namely, the second conductor R21 and the fourth conductor R22 of the second conducting group G2 are electrically connected to the first metal conducting wire C1 and the second metal conducting wire C2, respectively. Also, the first conductor T11 and the third conductor T12 of the first conducting group G1 are electrically connected to the first metal plate P1 and the second metal plate P2, respectively. The specification, such as length, width, pitch of the first metal conducting wire C1 and the second metal conducting wire C2, and the first metal plate P1 and the second metal plate P2 can be designed. Hence, the crosstalk noise induced between the first signal loop pair L1 and the second signal loop pair L2 can be reduced and even canceled when signals are sent through either of the two signal loop pairs L1, L2. The compensation capacitance Cr1*r*2 is provided by the first metal conducting wire C1 and the second metal conducting wire C2, and the compensation capacitance Ct1*t*2 is provided by the first metal plate P1 and the second metal plate P2. Hence, the totally equivalent compensation capacitance is the total sum of the compensation capacitance Cr1*r*2 and the compensation capacitance Ct1*t*2 when the metal conducting wires C1, C2 of the first conducting group G1 and the metal plates P1 and P2 of the second conducting group are simultaneously used.

Accordingly, in this embodiment, the equivalent capacitance Ct1*t*2 can be provided by electrically connecting the first conductor T11 to the second metal plate P2 and electrically connecting the third conductor T12 to the first metal plate P1. The difference between this embodiment and the above-mentioned embodiment is only the connection relationship. Hence, the detail description is omitted here for conciseness.

The electrical connector with crosstalk compensation is provided to reduce and even cancel the crosstalk noise induced between the first signal loop pair L1 and the second signal loop pair L2 by using only the metal conducting wires or the metal plates and even both the metal conducting wires and the metal plates.

Figure 7:
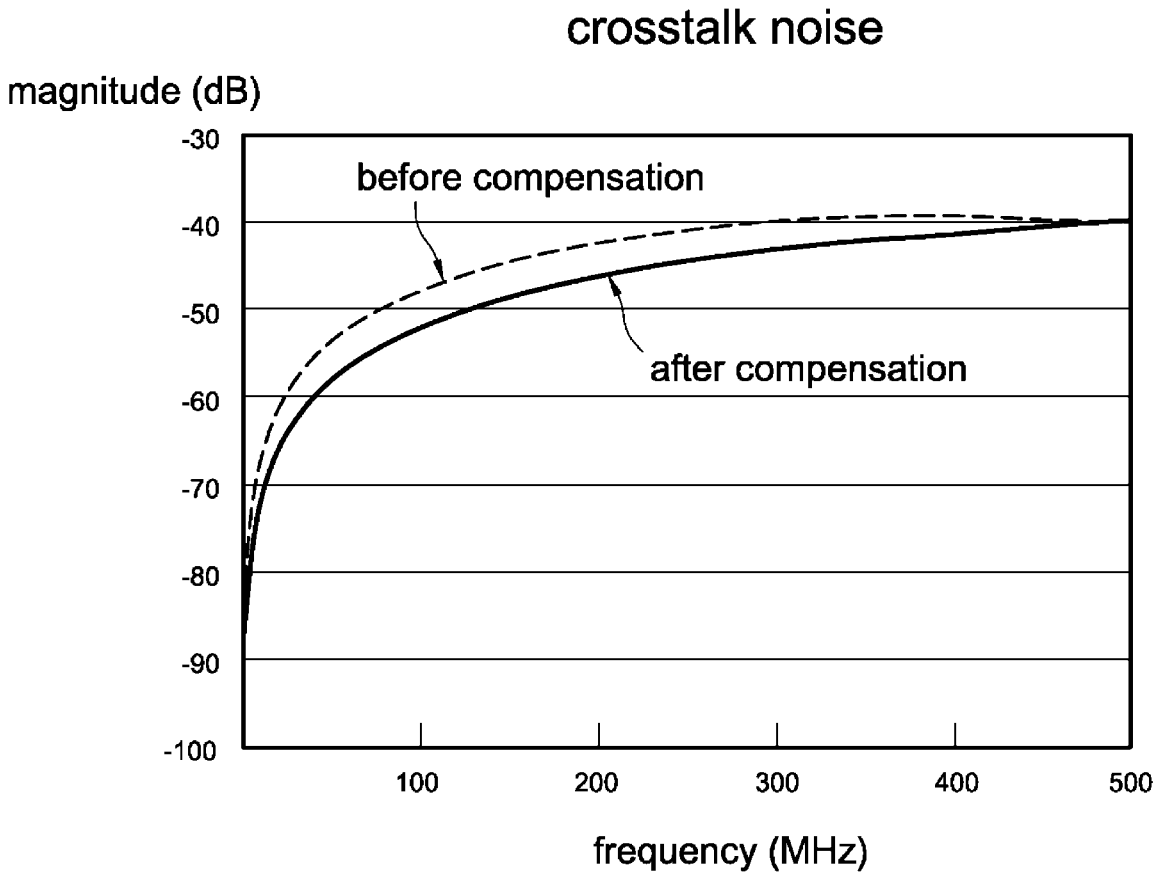
FIG. 7 is a curve chart of showing the result before and after compensation of the embodiment shown in FIG. 2A.

Reference is made to FIG. 7 which is a curve chart of showing the result before and after compensation of the embodiment shown in FIG. 2A. As shown in FIG. 7, the abscissa represents the frequency (in Megaherz) and the ordinate represents the crosstalk magnitude (in dB). A dashed line represents the crosstalk magnitude induced between the two signal loop pairs L1, L2 without using the metal conducting wires C1, C2 (namely before compensation). A solid line represents the crosstalk magnitude induced between the two signal loop pairs L1, L2 by using the metal conducting wires C1, C2 (namely after compensation). The test data are 8-mm-length, 0.254-mm-width, and 0.254-mm-pitch metal conducting wires C1, C2. As shown in FIG. 7, the reduced crosstalk magnitude is approximately 5 dB between 1 to 500 MHz, and more particularly the reduced degree of the crosstalk magnitude is significant between 50 to 350 MHz.

In conclusion, the present invention has following advantages: The specification, such as length, width, pitch of the metal conducting wires C1, C2 or the metal plates P1, P2 can be designed according to the measured coupled capacitance. Hence, the crosstalk noise induced between the first signal loop pair L1 and the second signal loop pair L2 can be reduced and even canceled when signals are sent through either of the two signal loop pairs L1, L2.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An electrical connector with crosstalk compensation comprising:

a substrate (10);

a first conducting group (G1), installed on the substrate (10) and having at least four conductors;

wherein the four conductors have a first conductor (T11), a second conductor (R11), a third conductor (T12), and a fourth conductor (R12), respectively; the first conductor (T11) and the second conductor (R11) forming a first conducting pair (S11), and the third conductor (T12) and the fourth conductor (R12) forming a second conducting pair (S12);

a second conducting group (G2), installed on the substrate (10) and having at least four conductors;

wherein the four conductors have a first conductor (T21), a second conductor (R21), a third conductor (T22), and a fourth conductor (R22), respectively; the first conductor (T21) and the second conductor (R21) forming a first conducting pair (S21), and the third conductor (T22) and the fourth conductor (R22) forming a second conducting pair (S22);

wherein the first conducting pair (S21) of the second conducting group (G2) is electrically connected to the first conducting pair (S11) of the first conducting group (G1) to form a first signal loop pair (L1); and the second conducting pair (S22) of the second conducting group (G2) is electrically connected to the second conducting pair (S12) of the first conducting group (G1) to form a second signal loop pair (L2);

a first metal conducting wire (C1) electrically connected to the second conductor (R21) of the second conducting group (G2);

a second metal conducting wire (C2) electrically connected to the fourth conductor (R22) of the second conducting group (G2);

whereby the first metal conducting wire (C1) and the second metal conducting wire (C2) are installed in parallel on the substrate (10) to obtain a compensation capacitance to reduce a crosstalk induced between the first signal loop pair (L1) and the second signal loop pair (L2) when signals are sent through either of the two signal loop pairs (L1, L2).

2. The electrical connector in claim 1, wherein the first metal conducting wire (C1) is electrically connected to the first conductor (T21) of the second conducting group (G2), and the second metal conducting wire (C2) is electrically connected to the third conductor (T22) of the second conducting group (G2).

3. The electrical connector in claim 1, wherein the first metal conducting wire (C1) and the second metal conducting wire (C2) are both of the line structure.

4. The electrical connector in claim 2, wherein the first metal conducting wire (C1) and the second metal conducting wire (C2) are both of the comb-shaped structure.

5. The electrical connector in claim 4, wherein the first metal conducting wire (C1) and the second metal conducting wire (C2) are interleavingly installed to increase the area between thereof.

6. The electrical connector in claim 1, further comprising:

a first metal plate (P1) electrically connected to the first conductor (T11) of the first conducting group (G1); and a second metal plate (P2) electrically connected to the third conductor (T12) of the first conducting group (G1);

whereby the first metal plate (P1) and the second metal plate (P2) are installed in parallel on upper surface and lower surface of the substrate (10) to obtain a compensation capacitance to reduce 1 a crosstalk induced between the first signal loop pair (L1) and the second signal loop pair (L2) when signals are sent through either of the two signal loop pairs (L1, L2).

7. The electrical connector in claim 1, wherein the substrate (10) is a printed circuit board.

* * * * *